United States Patent [19]

Tamada et al.

[11] 4,034,207

[45] July 5, 1977

[54] POSITIVE TEMPERATURE COEFFICIENT SEMICONDUCTOR HEATING ELEMENT

[75] Inventors: Minoru Tamada; Takashi Shikama; Toshikazu Nakamura, all of Yokaichi, Japan

[73] Assignee: Murata Manufacturing Co., Ltd., Kyoto, Japan

[22] Filed: Apr. 30, 1976

[21] Appl. No.: 682,161

[30] Foreign Application Priority Data

| | | |
|---|---|---|
| Jan. 23, 1976 | Japan | 51-7123[U] |
| Jan. 23, 1976 | Japan | 51-7124[U] |
| Jan. 29, 1976 | Japan | 51-14640[U] |
| Jan. 29, 1976 | Japan | 51-14642[U] |
| Jan. 29, 1976 | Japan | 51-14645[U] |
| Jan. 29, 1976 | Japan | 51-14647[U] |

[52] U.S. Cl. ..... 219/517; 219/504; 219/553; 337/1; 337/159; 338/22 SD; 338/309

[51] Int. Cl.[2] ..... H05B 1/02

[58] Field of Search .... 338/195, 22, 262, 307–309, 338/313; 337/1, 3, 4, 5, 158, 159, 160, 290, 401, 416; 29/611, 612, 623; 219/552, 553, 517, 209, 504

[56] References Cited

UNITED STATES PATENTS

| | | | |
|---|---|---|---|
| 3,836,883 | 9/1974 | Takayasu et al. | 337/159 X |
| 3,887,893 | 6/1975 | Brandt et al. | 338/262 |
| 4,006,443 | 2/1977 | Kouchich et al. | 219/517 X |

FOREIGN PATENTS OR APPLICATIONS

| | | | |
|---|---|---|---|
| 1,342,762 | 1/1974 | United Kingdom | 337/1 |

*Primary Examiner*—C. L. Albritton
*Attorney, Agent, or Firm*—Birch, Stewart, Kolasch & Birch

[57] ABSTRACT

An arrangement of electrode for positive temperature coefficient semiconductor (PTCS) for use in heating and drying devices and the like, which PTCS is provided with a pair of electrode plates, each having a fork-like configuration with a plurality of branches or fingers in the form of strips extending forward from its base. The strips of both electrodes are disposed alternately on one of the opposing planes of the PTCS body. Each electrode has an extended portion serving as terminal which is bonded on the other plane of the PTCS body in such a manner that the terminal is not confronted, through the PTCS body, with any strips of opposite electrode.

12 Claims, 20 Drawing Figures

POSITIVE TEMPERATURE COEFFICIENT SEMICONDUCTOR HEATING ELEMENT

The present invention relates to a positive temperature coefficient semiconductor (PTCS), and more particularly to an arrangement of electrodes for the PTCS, for use in heaters, and other devices of the like.

It is known to use such PTCS as a heating element, in which electrical energy is converted into thermal energy. When a suitable voltage is applied to the PTCS material, such as a thermistor, the current flowing therethrough is comparatively high at initial stage, so that the PTCS material is heated rapidly up to certain temperature called anomaly temperature, which is in relation to the applied voltage. Thereafter, the current drops to a low value to reduce heat generation from the PTCS, thus maintaining the anomaly temperature.

Referring to FIGS. 1 and 2, showing a conventional PTCS heating element which is normally formed from a PTCS body having two opposite flat surfaces on which are deposited strips of metal film which serve as the electrodes.

Each of the electrodes has a fork-like shape with a plurality of branches or fingers in the form of thin strips extending from its base in spaced relation to each other for providing, on the PCTS body, increased area effective for heat generation. For the purpose of connecting lead wires onto the PTCS body, the metal film for the electrode is further provided with an extension which serves as terminals. Electrical current normally flows from one of the electrodes (first electrode) to the neighboring opposite electrode (second electrode). When the second electrode is placed on the same plane as the plane which the first electrode is placed on, the current will flow through the outer regions of the body. However, on the other hand, when the second electrode is placed on the opposite plane to the plane which the first electrode is placed on, the current will flow through the inner region of the PTCS body in the direction of thickness of said body. From the view point of rapid response in the heat emission with respect to the current, it is desirable to have the thermal energy generating region at the outer regions of the PTCS body. Although there has been proposed conventionally the PTCS heating element with its pair of electrodes placed on the same flat plane, the terminals for the electrodes are placed on the other flat plane of the PTCS body in such a manner that the terminal for the first electrode partly cross overs or overlaps through PTCS body with the second electrode, thus allowing some current to flow across the PTCS body in the direction of its thickness, resulting in sluggishness in the heat emission.

Such a current of flowing in the direction of thickness of the PTCS body not only results in sluggish heat emission, but also represents an undesirable feature in the PTCS body especially in those PTCS elements for use in comparatively high temperature, for instance an uneven temperature distribution in the body.

Referring to FIG. 3, showing the resistance-temperature characteristics graph of the PTCS body, when a predetermined amount of voltage is applied to the PTCS body, the temperature thereof rises in relation to the increase of the resistance within a certain point TN, defined as ($R_o$, $T_o$) in the graph and maintains its condition. However if the voltage increases more than the predetermined amount, the temperature of the PTCS body increase more than $T_o$, and the decrease in the resistance draws a high in rush current, and thus the temperature will ceaselessly increase till the PTCS body is cracked or broken into pieces. Therefore, it is preferable to operate the PTCS body within the temperature of $T_o$. And from the view point of effective operation of the PTCS body, it is preferable to keep the temperature distribution of the PTCS body in even level. In other words, the maximum operating temperature, i.e., near the temperature of $T_o$, should be brought at the same time, from the edge portions to the center portion of the PTCS body.

However, when considering the conventional PTCS heating elements, the uneven temperature distribution is caused not only by the reason in the forgoing description, but also by the following reason.

Referring again to FIGS. 1 and 2, the strips of metal film for the first and second electrodes are normally disposed in such a manner that the distance between the edges of the first and second electrodes are constant, thus generating approximately the same amount of heat from the PTCS body. As a consequence, as it is common in most substances, the generated heat in the PTCS body is more apt to be emitted from the peripheral edge portions of the PTCS body than the inner portion thereof. Therefore, the conventional PTCS heating element tends to have an uneven temperature distribution, i.e., more heat stays in the center portion than the peripheral edge portions of the PTCS body. Such an uneven temperature distribution results in an uneven expansion in the body thus causing the PTCS body to crack during its operation, or may not operate the PTCS body in the maximum temperature.

It is therefore a primary object of the present invention to provide a PTCS heating element which generates heat effectively from at least one of opposing flat surfaces.

It is another object of the present invention to provide a PTCS heating element of the above described type in which the heat distribution in the PTCS body is maintained evenly.

It is a further object of the present invention to provide a PTCS heating element of the above described type having large heating area.

It is still further object of the present invention to provide a PTCS heating element of the above described type having fuse means formed therein.

According to the PTCS heating element of the present invention, the PTCS body having two opposite flat surfaces is provided with two sets of alternately disposed electrodes on one of the flat surfaces. Each electrode has a plurality of strips having a finger-like shape, in which, each strip is disposed in such a manner that the neighboring electrodes are members of opposite sets of electrodes. Each electrode is further provided with a sheet of metal film which serves as an electrical terminal, disposed on the other flat surface of the PTCS body in such a manner that the finger-like strips of opposite electrode do not overlap, through the PTCS body, with the sheet of metal film.

When a voltage source is connected between the two terminals, the electrical currents in the PTCS body tends to flow predominantly near the body surface between neighboring electrodes. Thus only a thin outer region of the PTCS body between the two opposite electrodes acts as the thermal energy generating region, thereby enabling quick response of heat emission to take place in relation to the electrical currents.

Furthermore, according to the present invention, the fork-like electrodes are provided more densely in the edge portions than the center portion. Thus the thermal energy produced per unit area is larger in the edge portions than the center portion, thereby balancing the temperature distribution between the center portion and the edge portions of the PTCS body in even level.

Another type of PTCS heating element which is the modification of above described type has wide strips of finger-like electrode in the center portion, and narrow strips thereof in the edge portions, whereby more of generated heat in the center portion can be absorbed in the non-generating portions of the PTCS body, i.e., under the electrodes, than in the edge portions.

These and other objects and features of the present invention will become more apparent from the following description taken in conjunction with a preferred embodiment thereof with reference to the accompanying drawings, wherein.

Before the description of the present invention proceeds, it is to be noted that like elements are designated by like reference numerals throughout the views of the attached drawings.

Figure 1:
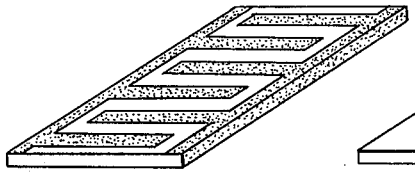
Prior Art FIG. 1
Figure 2:
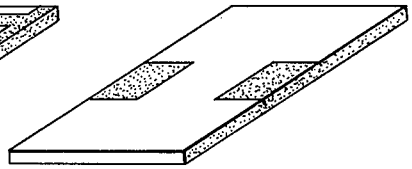
Prior Art FIG. 2
Figure 3:
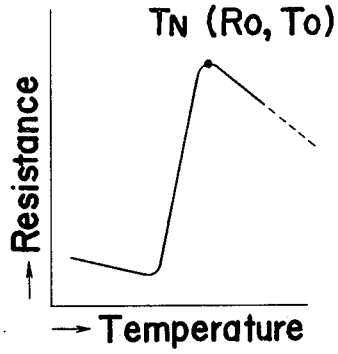
Figure 4:
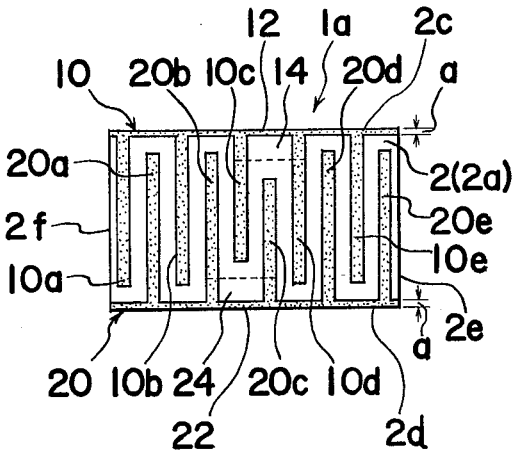
FIGS. 4 and 5 are top and bottom plane views of the PTCS heating element of the present invention.
Figure 5:
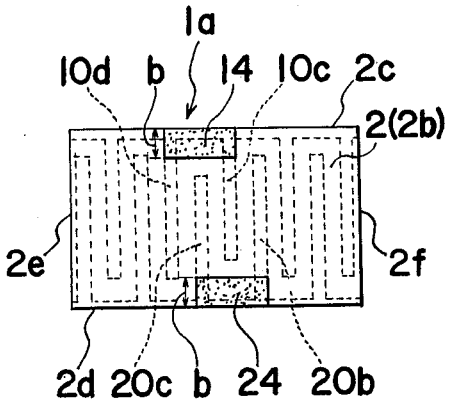

Referring to FIGS. 4 and 5, a positive temperature coefficient semiconductor (PTCS) heating element 1*a* of the present invention comprises a PTCS body 2 and a pair of electrodes 10 and 20. The PTCS body 2 has a rectangular shape having two opposite flat and mutually parallel faces 2*a* and 2*b* and two pairs of opposing perimeter faces 2*c*, 2*d*, 2*e* and 2*f*. On the top face 2*a* of the PTCS body 2 are bonded two metal film electrodes 10 and 20. The electrode 10 has comparatively narrow five long strips 10*a*, 10*b*, 10*c*, 10*d* and 10*e* formed in a finger-like shape and extending from one perimeter face 2*c* transversely across the face 2*a* and separated from each other by about the same distance along their respective lengths. Among five long strips, at least one strip, for example, the strip 10*c* in the center is shorter than the other strips, while the remaining four strips 10*a*, 10*b*, 10*d* and 10*e* are extended up to a position adjacent to the opposite perimeter face 2*d*. These five strips 10*a* to 10*e* are electrically connected to each other by a base film 12 running along the perimeter 2*c*, in which the width *a* is narrowed as much as possible for not occupying large heat generating area. On the other hand, the electrode 20 extending from the perimeter face 2*d* also has five long strips 20*a*, 20*b*, 20*c*, 20*d* and 20*e* in the similar pattern to that of the electrode 10, with a base film 22 electrically connecting the strips to each other. Each strip is positioned in such a manner that neighboring strips are members of opposite electrode.

On the opposite face 2*b* of the PTCS body 10, two sheets of metal films serving as terminals 14 and 24 for the electrodes 10 and 20, respectively, are bonded at the opposing rims neighboring the perimeters 2*c* and 2*d*. The widths *b* of the terminal 14 and 24 are comparatively large for allowing easy connection of lead wire (not shown) thereon. As most clearly seen in FIG. 5, the terminal 14 for the electrode 10 is located at the face 2*b* related to the space between the strips 10*d* and 10*c* and in separate relation from the strip 20*c* of the opposite electrode 10. More specifically, the distance between the edge of the terminal 14 and the tip of the strip 20*c*, diagonally crossing the PTCS body 2 is not smaller than the distance between the neighboring strips. It is needless to say that the terminal 14 is electrically connected to the electrode 10. The terminal 24 is also bonded on the opposing rim adjacent to the perimeter 2*d*, in a similar manner to the terminal 14.

When a suitable voltage is applied between the terminals 14 and 24, the current flows from the electrode 10 to the electrode 20 (or in the opposite direction) predominantly near the face 2*a*, which is equal to a heat generating region.

Since one electrode, for example electrode 10, including its terminal 14 does not overlap or cross over, through the PTCS body 2, with the opposite electrode 20, the current is not at all likely to flow in the direction of thickness of the body 2, thus the generated heat being rapidly emitted from the face 2*a*, and also the PTCS body can be formed in comparatively thin layer, yet presenting enough heat generating region between the strips.

Figure 6:
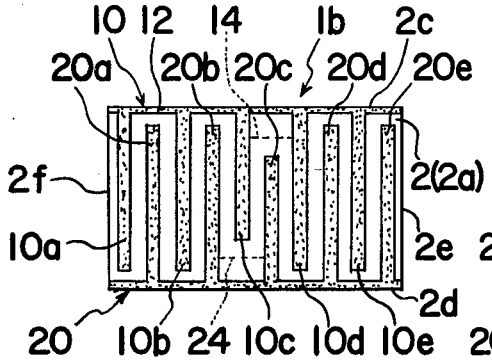
FIGS. 6 and 7 are similar views to FIGS. 4 and 5, but showing a modification thereof.
Figure 7:
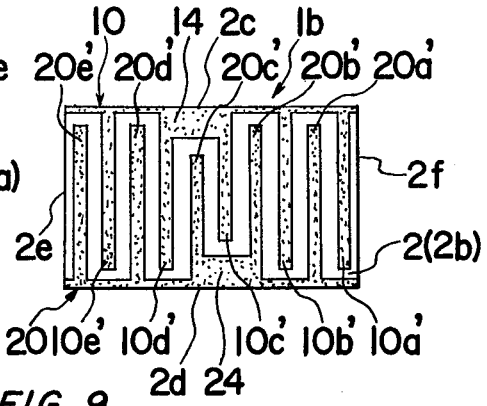

Referring to FIGS. 6 and 7, there is shown a PTCS heating element 1*b* which is a modification of the heating element 1*a* described above and is available for producting heat from both of the opposite faces 2*a* and 2*b*. The PTCS heating element 1*b* in this embodiment further comprises, in addition to PTCS heating element 1*a* of preceding embodiment, a set of opposing electrodes 10 and 20 being bonded on the face 2*b*, in a similar manner to those bonded on the face 2*a*. More specifically, the electrode 10 further has five long strips 10*a*', 10*b*', 10*c*', 10*d*' and 10*e*' disposed on the face 2*b* in such a manner that respective strips directly face, through the PTCS body 2, with the five long strips 10*a* to 10*e*. Similarly, the strips 20*a*', 20*b*', 20*c*', 20*d*' and 20*e*' for the electrode 20 are bonded on the face 2*b* so as to face the strips 20*a* to 20*e* through the PTCS body 2.

The PTCS heating element 1*b* in this embodiment is particularly suitable to those cases when it is necessary to have the heating element to emit the heat from both of the opposing faces 2*a* and 2*b* of the body 2.

Since the strips of one electrode do not face with the members of other electrode, the current is not at all likely to flow through in the direction of the thickness, and thus the generated heat is rapidly emitted from the faces 2*a* and 2*b*, while the PTCS body can be formed in comparatively thin layer.

Figure 8:
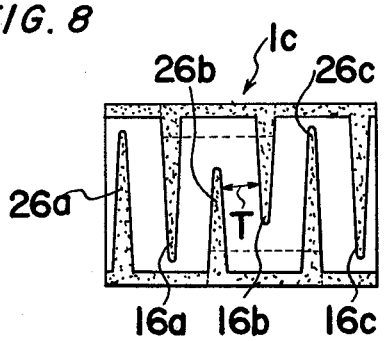
FIGS. 8 and 9 are similar views to FIGS. 4 and 5, but showing another modification thereof.
Figure 9:
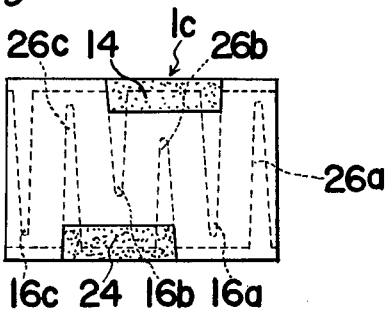

Referring to FIGS. 8 and 9, there is shown a PTCS heating element 1*c*, which is an another modification of PTCS heating element 1*a*. In this embodiment the electrode 10 comprises strips 16*a*, 16*b* and 16*c*, while the electrode 20 comprises strips 26*a*, 26*b* and 26*c*. Each of the strips, for example a strip 26*a*, is suitably tapered as shown, in which the width thereof is gradually narrowed toward the tip portion, whereby the space between the neighboring strips is broadened, when compared with that in the forgoing embodiments, thus obtaining larger heat producing area. It is needless to say that the strips 16*b* and 26*b* are shorter than the other strips for the same reason described above.

Since the heat producing area occupies such a large area, this PTCS heating element 1*c* is particularly suitable for producing high temperature.

Figure 10:
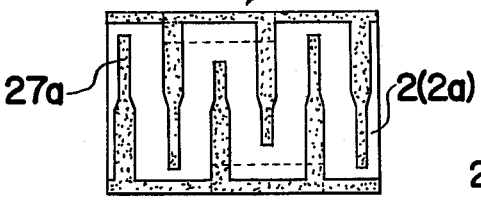
FIGS. 10 and 11 are similar view to FIGS. 8 and 9, but showing a further modification thereof.
Figure 11:
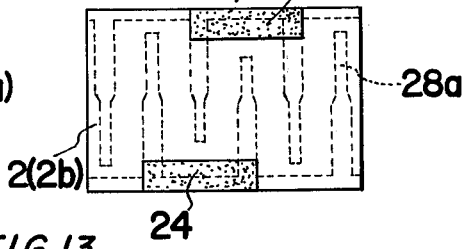

It should be noted that the strips in this embodiment described as tapered can be formed in any other shape such as those strips 27*a* shown in FIG. 10 and 11, so long as the tip portion thereof is narrowed in comparison with the root portion.

It should also be noted that the PTCS heating elements 1*c* and 1*c'* described in connection with FIGS. 8 to 11 can be provided with further strips on the opposing face 2*b* as described in connection with FIGS. 6 and 7.

Figure 12:
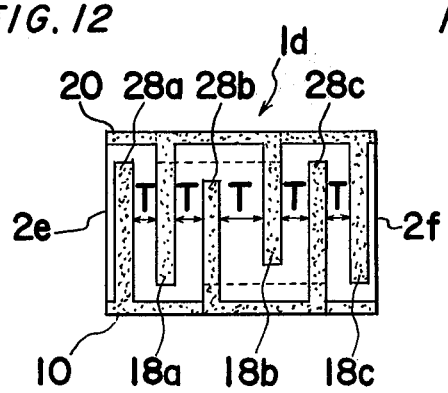
FIGS. 12 and 13 are similar views to FIGS. 4 and 5, but showing still another modification thereof.
Figure 13:
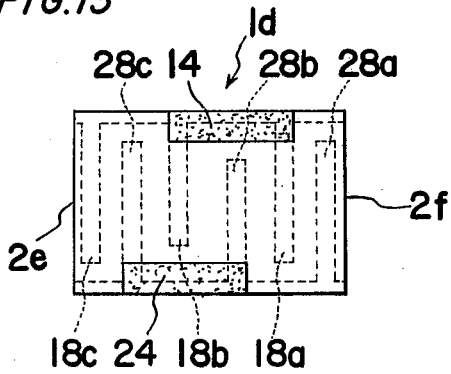

Referring to FIGS. 12 and 13, there is shown a PTCS heating element 1*d*, which is a further modification of PTCS heating element 1*a*. The PTCS heating element in this embodiment being capable of generating greater rates of heat output, has the electrode 10 which comprises strips 18*a*, 18*b* and 18*c*, and the electrode 20 which comprises strips 28*a*, 28*b* and 28*c*, in which the strips 18*b* and 28*b* are shorter than the other strips. Although the strips in this embodiment are disposed alternately in a similar manner to those of forgoing embodiments, the distance T between the strips is widest in the center portion thereof, i.e., between the strips 18*b* and 28*b*, and gradually becomes narrower towards the opposing perimeters 2*e* and 2*f*.

When a suitable voltage is applied between the terminals 14 and 24, the current flows between the two electrodes 10 and 20 and generates predominantly much heat from the PTCS body 2 near the face 2*a* and, particularly between the strips. Since the distance between the strips in the center portion is widest and becoming narrower towards edge portions, the heat generated in the center portion per unit area is smaller than that at the edge portions, so that the generated thermal energy is high in the edge portions and low in the center portion. However, due to the heat emitting characteristics possessed by the solid body, for example, the PTCS body 2, the heat existing at the edge portions are likely to be emitted more rapidly than that in the center portion, thus it is possible to maintain the temperature distribution in the PTCS body 2 in fairly even level, especially when the PTCS heating element is heated up to near the anomaly temperature.

Figure 14:
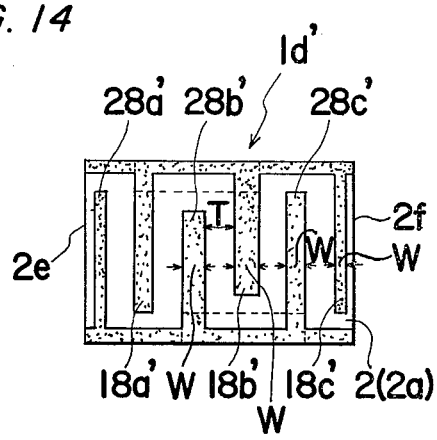
FIGS. 14 and 15 are similar views to FIGS. 12 and 13, but showing a further modification thereof.
Figure 15:
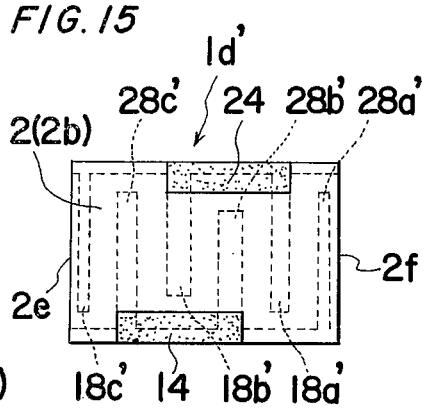

Referring to FIGS. 14 and 15, there is shown a PTCS heating element 1*d'*, which is a modification of PTCS heating element 1*d*. The PTCS heating element 1*d'* in this embodiment is also capable of generating greater rates of heat output, and has electrode 10 comprising strips 18*a'*, 18*b'* and 18*c'* and electrode 20 comprising strips 28*a'*, 28*b'* and 28*c'* disposed alternately, and the strips 18*b'* and 28*b'* which are shorter than the other strips, as in the forgoing embodiments. Although the distance T between the electrodes is arranged to be approximately constant, the width W of the each strip is widest at the center portion thereof, i.e., the strips 18*b'* and 28*b'*, and gradually becomes narrower towards the opposing perimeters 2*e* and 2*f*.

Upon receipt of the voltage between the terminals 14 and 24, the PTCS heating element is excited to generate heat from the PTCS body 2, especially between the strips and predominantly near the face 2*a*. Most of the generated heat is emitted from the face 2*a*, but some heat is absorbed in the PTCS body 2 in a non-heating regions which exist under each of the strips. Since the strips in the center portion occupies larger area in the PTCS body 2, more heat is likely to be absorbed in the center portion, in comparison with the edge portions. When the PTCS heating element 1*d'* is heated up to a comparatively high temperature, the generated heat at the center portion thereof is partly absorbed in the PTCS body 2, while the heat generated at the edge portion thereof is emitted in greater rate, thus it is possible to make the temperature distribution in the PTCS body 2 in fairly even level.

Therefore, the PTCS bodies 2 employed in the PTCS heating elements 1*d* and 1*d'* are not likely to crack while using in high temperature and have good shock resistance, and yet do not allow any current components flowing through the PTCS body 2 in the direction of its thickness, and thus the PTCS body 2 therefor can be formed in comparatively thin layer.

It should be noted that the PTCS heating element 1*d* and 1*d'* can be further provided with strips on the opposing face 2*b* as described above in connection with FIGS. 6 and 7.

Figure 16:
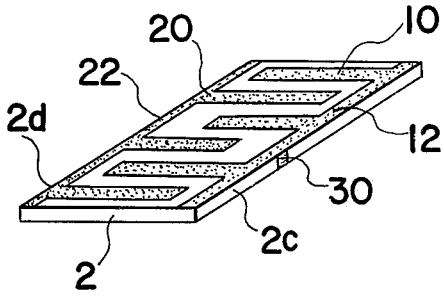
FIGS. 16 and 17 are perspective views as seen the top and bottom of the PTCS heating element of the present invention, particularly showing the fuse means.
Figure 17:
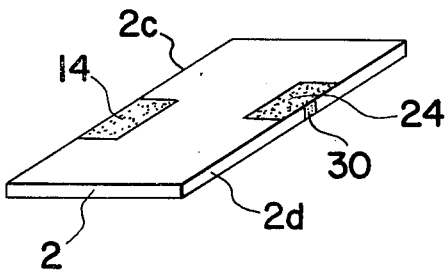

Referring now to FIGS. 16 and 17, showing fuse means 30 formed in each of the electrodes 10 and 20. The fuse means 30 is formed at perimeter faces 2*c* and 2*d* of the PTCS body 2 and formed by a narrowed sheet of metal film connecting each of the terminals 14 and 24 with the respective electrodes 10 and 20 at the base films 12 and 22. Such fuse means 30 can be employed in those PTCS heating elements described above or in others.

Upon receipt of the voltage between the terminals 14 and 24, the current normally flowing through the fuse means 30 is within its tolerance, thus exciting the PTCS body 2 and generating heat in the above described manner. However, if the PTCS heating element is subjected to an excessive current caused by a short circuit between the electrodes 10 and 20 or deterioration in the dielectric strength in the body 2, the fuse means 30 will break and disconnect the terminal with the electrode, before the PTCS body 2 may crack or broken into pieces.

Therefore, such fuse means 30 is not only possible to save the PTCS body 2 from destruction, but also protect the neighboring components from being damaged by such cracked pieces or by the excessive current.

It should be noted that the fuse means 30 described as formed by the narrowed sheet of metal film can be formed by a thinner layer of metal film than that of the strips and terminals, or by an electrically conductive material which is easier to fuse than the electrodes and the terminals. For example, if the electrodes and terminals were formed by silver, the fuse means 30 can be formed by a film of nickel, stainless steel, aluminum, copper or tin, etc.

Figure 18:
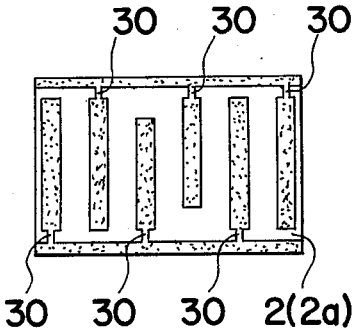
FIG. 18 is a top plane view of the PTCS heating element, particularly showing the fuse means in another modification.

It should also be noted that the fuse means 30 described as formed at perimeter faces 2*c* and 2*d* can be formed at end portion of each strip adjacent to the respective base films 12 and 22, as clearly shown in FIG. 18.

Figure 19:
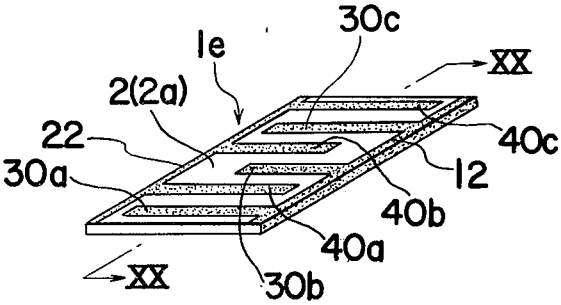
FIG. 19 is a perspective view of the PTCS heating element of yet another modification.
Figure 20:
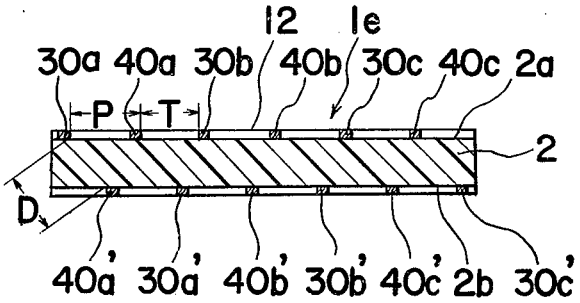
FIG. 20 is a cross sectional view taken along the line XX—XX of FIG. 19.

Referring to FIGS. 19 and 20, the PTCS heating element in this embodiment comprises the PTCS body 2 and the pair of electrodes 10 and 20 each having a plurality of metal film strips disposed on the opposing faces 2*a* and 2*b*. The strips 30*a*, 30*b* and 30*c* of the electrode 10 and the strips 40*a*, 40*b* and 40*c* of the electrode 20 are alternately disposed on the face 2*a*, while the strips 30*a*', 30*b*' and 30*c*' of the electrode 10 and the strips 40*a*', 40*b*' and 40*c*' of the electrode 20 are also alternately disposed on the face 2*b* in the similar manner to those shown in FIGS. 6 and 7. The strips of the same electrode, however, are not facing directly towards each other through the PTCS body 2, but are shifted for about half a pitch P which is the distance between the respective edges of neighboring strips. The PTCS body 2 in this embodiment is prepared in such a manner that the diagonal distance D thereof between the edges of strips for opposing electrodes is almost same as the distance T which is the distance between the neighboring strips.

When the voltage is applied between the terminals (not shown in FIGS. 19 and 20), the current flows between the neighboring strips predominantly through the ranges near the faces 2*a* and 2*b*. In addition, almost the same amount of current flows diagonally through the PTCS body 2 between the strips of opposing electrodes, for example between the strips 30*a* and 40*a*'. Such current flowing through the PTCS body generates thermal energy to heat the PTCS body itself, while the current flowing predominantly through the range near the faces 2*a* and 2*b* generates thermal energy to be emitted from the PTCS heating element. Therefore, the heat generated by the current flowing through the ranges near the faces 2*a* and 2*b* is not at all absorbed in the PTCS body 2, but is totally emitted from the respective faces 2*a* and 2*b*.

Therefore, the PTCS heating element 1*e* in this embodiment can effectively emit heat from the faces 2*a* and 2*b* in relation to the current flowing through the range near the faces 2*a* and 2*b*.

It should be noted that the number of strips for the electrodes can be any preferable number, according to the size and type of the PTCS heating element.

It should also be noted that the PTCS body 2 described as formed in a shape of rectangular can be formed in any other shapes such as a circle.

Although the present invention has been fully described by way of examples with reference to the accompanying drawings, it is to be noted that various changes and modifications are apparent to those skilled in the art. Therefore, unless such changes and modifications depart from the scope of the present invention, they should be construed as included therein.

What is claimed is

1. A positive temperature coefficient semiconductor (PTCS) heating element comprising:

a. a PTCS body having two opposite flat and mutually parallel faces;

b. a first electrode having a plurality of strips of metal film electrically connected to each other at its one end and being separated from each other along their respective length with at least one of said strips being shorter than other strips and said first electrode being provided on an upper face of said two faces of said PTCS body;

c. a second electrode having a plurality of strips of metal film electrically connected to each other at its one end and being separated from each other along their respective length with at least one of said strips being shorter than other strips and said second electrode being provided on said upper face in such a manner that the strips of opposite electrodes are alternately disposed on said upper face so that neighboring strips of respective strips are members of opposite electrode;

d. a first terminal of a pair of terminals for applying predetermined voltage, said first terminal being electrically connected to said first electrode and provided on a bottom face of said two faces at such a position that said first terminal does not overlap, through the PTCS body, with any of the strips of said second electrode; and e. a second terminal of said pair of terminals, said second terminal electrically connected to said second electrode and provided on said bottom face at such a position that said second terminal does not overlap, through the PTCS body, with any of the strips of said first electrode.

2. A PTCS heating element as claimed in claim 1, wherein said first electrode is further provided on said bottom face with a plurality of strips of metal film having the same pattern as those strips of said first electrode provided on said upper face of said PTCS body in such a manner that said strips of said first electrode on said upper face directly face, through said PTCS body, with said strips of said first electrode on said bottom face, and said second electrode is further provided on said bottom face with a plurality of strips of metal film having the same pattern as those strips of said second electrode provided on said upper face in such a manner that said strips of said second electrode on said upper face directly face, through the PTCS body, with said strips of said second electrode on said bottom face.

3. A PTCS heating element as claimed in claim 1, wherein each of said strips of metal film is formed in a tapered-shape.

4. A PTCS heating element as claimed in claim 1, wherein each of said strips of metal film is narrowed at end portion thereof.

5. A PTCS heating element as claimed in claim 1, wherein said strips are spaced from each other at distance being maximum in the center portion of said PTCS body and gradually decreasing towards edge portions thereof.

6. A PTCS heating element as claimed in claim 1, wherein width of said strip in the center portion of said PTCS body is widest and gradually narrowed towards edge portions.

7. A PTCS heating element as claimed in claim 1, wherein at least one of said first and second electrodes is connected to corresponding terminal through a fuse means.

8. A PTCS heating element as claimed in claim 7, wherein said fuse means is formed by a narrowed strips of metal film.

9. A PTCS heating element as claimed in claim 7, wherein said fuse means is formed by fusible material.

10. A PTCS heating element as claimed in claim 7, wherein said fuse means is formed by a thin layer of metal film.

11. A PTCS heating element as claimed in claim 1, wherein each of said strips is formed with a fuse means at said one end thereof.

12. A positive temperature coefficient semiconductor (PTCS) heating element comprising:

a. a PTCS body having two opposite flat and mutually parallel faces;

b. a first electrode having a plurality of strips of metal film electrically connected to each other at its one end and being separated from each other along their respective length with at least one of said strips being shorter than other strips and said first electrode being provided on an upper face of said two faces of said PTCS body;

c. a second electrode having a plurality of strips of metal film electrically connected to each other at its one end and being separated from each other along their respective length with at least one of said strips being shorter than other strips and said second electrode being provided on said upper face in such a manner that the strips of opposite electrodes are alternately disposed on said upper face so that neighboring strips of respective strips are members of opposite electrode; and d. a pair of terminals for applying predetermined voltage between said first and second electrodes, each of said pair of terminals being electrically connected to said first and second electrodes, respectively, and provided on a bottom face of said two faces at such a position that at least one of said pair of terminals does not overlap, through the PTCS body, with any of the strips of opposite electrode.

* * * * *

UNITED STATES PATENT AND TRADEMARK OFFICE

CERTIFICATE OF CORRECTION

PATENT NO. : 4,034,207

DATED : July 5, 1977

INVENTOR(S) : Minoru TAMADA et al

It is certified that error appears in the above-identified patent and that said Letters Patent are hereby corrected as shown below:

IN THE HEADING OF THE PATENT

Under "[30] Foreign Application Priority Data", the list should read as follows:

- Jan. 23, 1976 Japan.....51-7123[U]

Jan. 23, 1976 Japan.....51-7124[U]

Feb. 9, 1976 Japan.....51-14640[U]

Feb. 9, 1976 Japan.....51-14642[U]

Feb. 9, 1976 Japan.....51-14645[U]

Feb. 9, 1976 Japan.....51-14647[U] --

Signed and Sealed this

Fourth Day of October 1977

[SEAL]

Attest:

RUTH C. MASON
Attesting Officer

LUTRELLE F. PARKER
Acting Commissioner of Patents and Trademarks